US007515729B2

(12) United States Patent
Watanabe

(10) Patent No.: US 7,515,729 B2
(45) Date of Patent: Apr. 7, 2009

(54) SPEAKER DEVICE

(75) Inventor: Tomoyuki Watanabe, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 654 days.

(21) Appl. No.: 11/083,992

(22) Filed: Mar. 21, 2005

(65) Prior Publication Data

US 2006/0120555 A1 Jun. 8, 2006

(30) Foreign Application Priority Data

Mar. 19, 2004 (JP) ..... 2004-080174

(51) Int. Cl.
*H04R 25/00* (2006.01)

(52) U.S. Cl. ..... 381/409; 381/353; 381/424; 381/398

(58) Field of Classification Search ..... 381/403–405, 381/407, 409, 410, 412, 398, 423, 424; 181/171, 181/172

See application file for complete search history.

(56) References Cited

U.S. PATENT DOCUMENTS 6,088,466 A * 7/2000 Proni ..... 381/397
6,327,371 B1 * 12/2001 Proni ..... 381/397
6,842,529 B2 * 1/2005 Koura et al. ..... 381/403
7,263,198 B2 * 8/2007 Onuma ..... 381/403
2004/0240702 A1 * 12/2004 Kaiwa et al. ..... 381/423

FOREIGN PATENT DOCUMENTS

JP 2003-158792 5/2003

* cited by examiner

*Primary Examiner*—Suhan Ni
*Assistant Examiner*—Jasmine Pritchard
(74) *Attorney, Agent, or Firm*—Young & Thompson

(57) ABSTRACT

A speaker device includes a terminal member, a connecting member and a voice coil. The connecting member has a terminal mounting part, a flat surface and a recessed portion. The terminal member is mounted to the terminal mounting part. On the flat surface, an inner peripheral edge portion of a diaphragm is mounted via an adhesive. A lead wire drawn from the voice coil is drawn along an outer peripheral wall of the voice coil bobbin and inside the recessed portion to be electrically connected to a connecting part of the terminal member. Thus, the lead wire is not sandwiched by the flat surface and the diaphragm. Thereby, at the time of driving the speaker device, pressure is not given to the lead wire drawn into the recessed portion from the diaphragm and the connecting member. The cut of the lead wire can be thus prevented.

4 Claims, 10 Drawing Sheets

SPEAKER DEVICE

TECHNICAL FIELD

The present invention relates to a structure of a connecting member in a speaker device.

BACKGROUND ART

Conventionally, there is known an internal magnet type speaker device including a magnetic circuit including a planar magnet, a planar plate and a pot-shaped yoke, and a vibration system including a conductive damper made by weaving a conductive member, a connecting member made of a resin material, a voice coil, a voice coil bobbin and a frame.

In such a speaker device, the connecting member movably supports the voice coil bobbin. The connecting member has a cylindrical portion and a bent portion. The cylindrical portion is formed into a substantially cylindrical shape, and is formed at a position opposite to an outer peripheral wall of the voice coil bobbin. The bent portion is bent downward from an upper end portion of the cylindrical portion to a center axial side of the connecting member.

In the above-mentioned speaker device, the lead wire drawn from the voice coil is sandwiched by the bent portion and the inner peripheral edge portion of the diaphragm on the upper surface of the bent portion. Therefore, at the time of driving the speaker device, unnecessary pressure and the like are given to the lead wire from the diaphragm and the connecting member, and the lead wire may be cut.

Additionally, since the inner peripheral edge portion of the diaphragm lies over the lead wire at the portion, a contact area of the bent portion and the inner peripheral edge portion of the diaphragm becomes small, and bonding strength (adhesion strength) of the connecting member and the diaphragm problematically decreases.

There is known a speaker device attempting to improve efficiency of an operation at the time of connecting a lead wire of a voice coil and a tinsel cord (see Japanese Patent Application Laid-Open under No. 2003-158792). According to the document, a neck part in an annular shape is provided on a diaphragm, and the neck part and the voice coil bobbin are fixed via an adhesive. Copper foil is attached on the voice coil bobbin, and holes through which the tinsel cords pass are formed on upper portions of the copper foil and the voice coil bobbin respectively. The tinsel cord passes through each hole, and is connected to the copper foil by soldering. At the same time, the lead wire of the voice coil is joined to a lower portion of the copper foil by the soldering. Thereby, the improvement of the efficiency of the operation at the time of connecting the lead wire of the voice coil and the tinsel cord is attempted.

DISCLOSURE OF THE INVENTION

As an object to be achieved by the present invention, the above described object is cited as an example. The present invention has its object to provide a speaker device having a connecting member capable of preventing a lead wire of a voice coil from being cut and improving bonding strength of a diaphragm and a connecting member.

According to one aspect of the present invention, there is provided a speaker device including: a frame; a damper which has an outer peripheral edge portion supported by the frame; a connecting member which is mounted to the damper and which movably supports a voice coil bobbin; a diaphragm which is mounted to the frame and the connecting member; and a voice coil which is wound around the voice coil bobbin, wherein the connecting member has a flat surface to which an inner peripheral edge portion of the diaphragm is mounted and a recessed portion which is formed on the flat surface and guides a lead wire of the voice coil.

In the above speaker device, the inner peripheral edge portion of the diaphragm is mounted on the flat surface. In addition, at least on the flat surface, the recessed portion guiding the lead wire of the voice coil is formed. The lead wire is guided into the recessed portion. Therefore, the lead wire in the recessed portion is not sandwiched by the inner peripheral edge portion of the diaphragm and the flat surface. Thereby, at the time of driving the speaker device, the pressure and the like are not given to the lead wire in the recessed portion from the diaphragm and the connecting member. Thus, it can be prevented that the lead wire is cut. Since the inner peripheral edge portion of the diaphragm does not lie over the lead wire, the contact area of the inner peripheral edge portion of the diaphragm and the flat surface becomes large. Therefore, the bonding strength (adhesion strength) of the diaphragm and the connecting member can be improved.

In a form of the above speaker device, the inner peripheral edge portion of the diaphragm may be mounted on the flat surface via an adhesive. Thus, the bonding strength of the inner peripheral edge portion of the diaphragm and the flat surface can be improved.

In another form, the speaker device may further include a terminal member which has a connecting part to be connected to the lead wire, wherein the connecting member has a terminal mounting part to which the terminal member is mounted, wherein a slit portion, extending to the recessed portion, which the connecting part is disposed at, is formed on an upper end surface of the connecting member, and wherein the lead wire is guided along an outer peripheral wall of the voice coil bobbin, the recessed portion and the slit portion to be connected to the connecting part. In a preferred example, the recessed portion may be formed at a position in a vicinity of the terminal mounting part and at an area from the flat surface to an inner peripheral edge portion of the connecting member.

In accordance with the form, the lead wire can be guided along the outer peripheral wall of the voice coil bobbin, the recessed portion and the slit portion to be electrically connected to the terminal member. Thereby, it can be prevented that the lead wire is cut.

In another form of the above speaker device, a depth of the recessed portion may be larger than a diameter of the lead wire. Thereby, the lead wire is not sandwiched by the inner peripheral edge portion of the diaphragm and the flat surface. Thus, it can be prevented that the lead wire is cut.

BEST MODE FOR CARRYING OUT THE INVENTION

A preferred embodiment of the present invention will be explained hereinafter with reference to the drawings. In this embodiment, the recessed (concave) portion is formed on the upper surface of the bent portion of the connecting member, in contact with the inner peripheral edge portion of the diaphragm. The lead wire drawn from the voice coil is guided into the recessed portion. Thereby, the bonding strength of the diaphragm and the connecting member is improved, and the cut of the lead wire is prevented.

Figure 1:
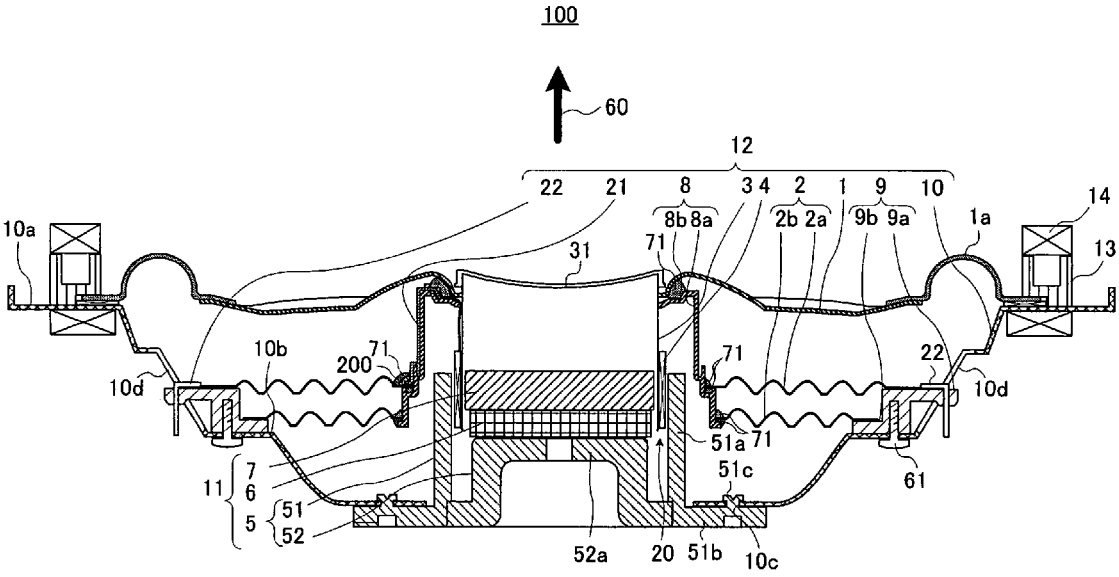
FIG. 1 shows a sectional view of a speaker device according to an embodiment of the present invention.
Figure 2C:
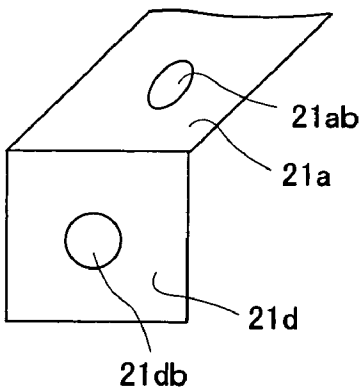
FIGS. 2A to 2C show perspective views of a terminal member according to this embodiment.
Figure 2B:
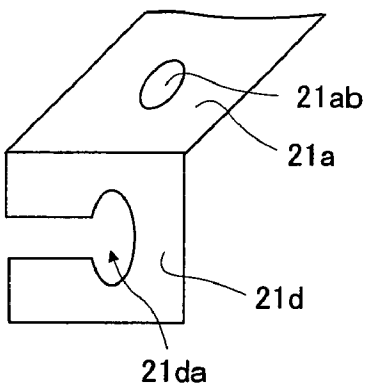
Figure 2A:
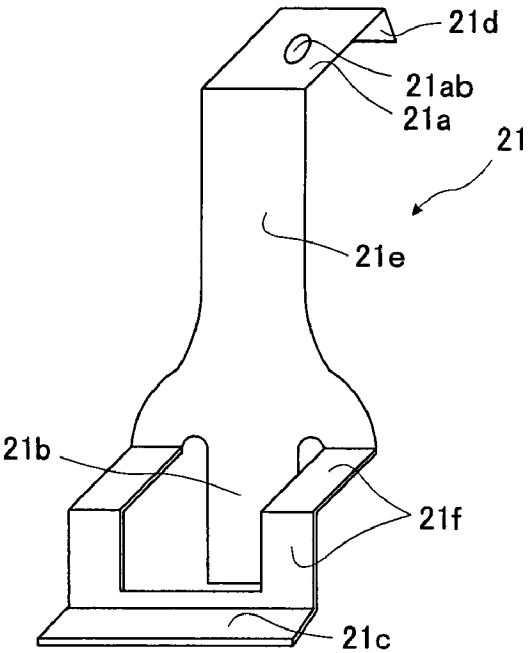
Figure 3:
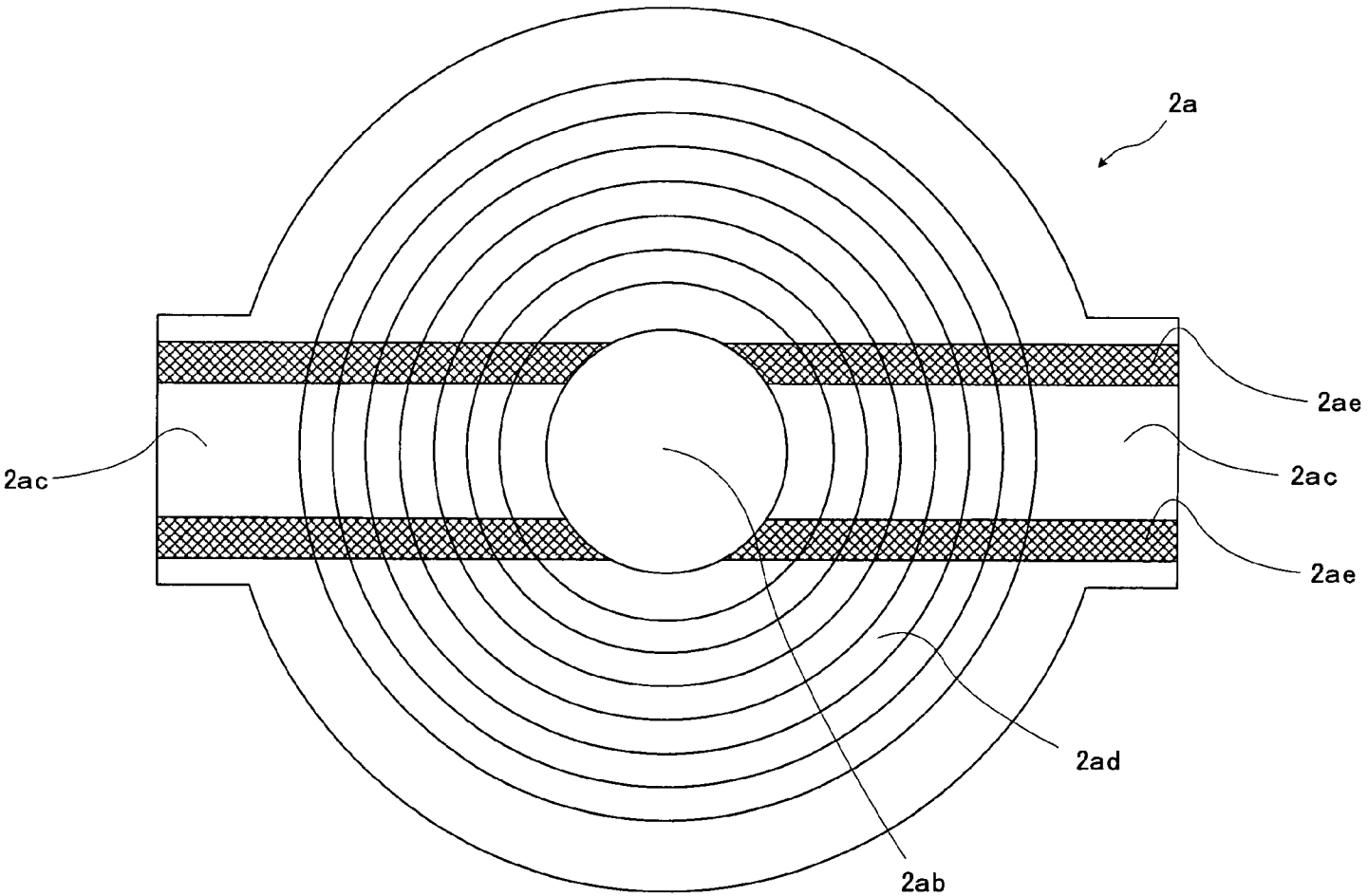
FIG. 3 shows a plan view of a conductive damper according to this embodiment.

FIG. 1 schematically shows a construction of a speaker device 100 according to the embodiment of the present invention. The speaker device 100 of this embodiment can be preferably used as the on-vehicle speaker. FIG. 1 shows a sectional view when cutting the speaker device 100 by a plane including a center axis thereof. FIG. 2A shows a perspective view of a terminal member 21. FIG. 2B shows a perspective view of an enlarged local part of a connecting part 21*d* at which a slit 21*da* is formed. FIG. 2C shows an enlarged perspective view corresponding to a local part in the vicinity of the connecting part 21*d* shown in FIG. 2A. In addition, FIG. 2C shows the enlarged perspective view of a local part of the connecting part 21*d* at which a hole 21*db* is formed, applicable to the terminal member 21. FIG. 3 schematically shows a plan view of a conductive damper 2*a*. The structure and the like of the speaker device 100 of this embodiment will be explained below, with reference to FIG. 1 to FIG. 3.

As shown in FIG. 1, the speaker device 100 mainly includes a vibration system 12 having a frame 10, a support member 9, a voice coil bobbin 3, a connecting member 8, a damper 2, terminal members 21, terminal members 22, a voice coil 4 and a diaphragm 1, a magnetic circuit system 11 having a pot type yoke 5, a magnet 6 and a plate 7, and an antidust cap 31 and various kinds of other members.

First, each of the components of the vibration system 12 will be explained.

Various components of the speaker device 100 are fixed to the frame 10, and the frame 10 has the function of supporting these components. The frame 10 is made of a metal material with favorable thermal conductivity. Therefore, the frame 10 has the function of a medium which transmits heat between an external space of the speaker device 100 and an internal space thereof. The frame 10 is formed into a pan-shape or a pot-shape which is opened upward, and has a first flange part 10*a* which is formed at an upper part and supports an outer peripheral edge portion or the like of the diaphragm 1, a second flange part 10*b* which is formed at an intermediate part and supports the support member 9, openings 10*c* formed in an inner peripheral edge portion, and a plurality of openings 10*d* formed at a side wall between the first flange part 10*a* and the flange part 10*b*. A plurality of openings 10*c* are formed in a circumferential direction of the inner peripheral edge portion with constant spaces between them. Each of projecting portions 51*c* of the pot-type yoke 5 before deformation, which will be described later, is inserted in each of the openings 10*c*.

The support member 9 is made of, for example, a resin material, and is formed into a substantially annular shape in the plane view. The support member 9 is formed into a step shape in the sectional view, and has an upper surface 9*a* and an upper surface 9*b*. The support member 9 is mounted to the second flange part 10*b* by a fixing member 61 such as a male screw and a bolt, for example.

The voice coil bobbin 3 is formed into a substantially cylindrical shape. The voice coil 4 is wound around an outer peripheral wall of a lower end portion of the voice coil bobbin 3. An inner peripheral wall of the lower end portion of the voice coil bobbin 3 is opposed to outer peripheral walls of the planar magnet 6 and plate 7 with a fixed space from them. Further, the outer peripheral wall of the lower end portion of the voice coil bobbin 3 is opposed to an outer peripheral wall of an upper end portion of a pole piece 5 with a fixed space apart from it. A clearance (a magnetic gap 20) is formed between the inner peripheral wall of the upper end portion of the pole piece 5 and the outer peripheral wall of the plate 7.

The connecting member 8 is made of a resin material, for example, and has a cylinder portion 8*a* formed into a substantially cylindrical shape and a bent portion 8*b* formed in a fashion being bent inwardly from an upper end of the cylinder portion 8*a*, and is made by integrally forming them. An inner peripheral edge portion of the connecting member 8, namely, the inner peripheral edge portion of the bent portion 8*b* is fixed to the vicinity of an upper end of the outer peripheral wall of the voice coil bobbin 3. The detailed construction of the connecting member 8 having a fixing structure of the present invention will be described later.

The damper 2 has a conductive damper 2*a* and an ordinary damper 2*b*.

The conductive damper 2*a* is disposed above the damper 2*b*. The conductive damper 2*a* includes an opening 2*ab*, a plurality of projecting parts 2*ac*, an elastic part 2*ad* and a plurality of conductive members 2*ae*.

The opening 2*ab* is formed substantially at a center of the conductive damper 2*a*. The connecting member 8 is inserted into this opening 2*ad*. A plurality of projecting parts 2*ac* are extended outside from an outer peripheral edge portion of the conductive damper 2*a* and are each formed into a substantially rectangular shape. The respective projecting parts 2*ac* are formed at the positions where they are symmetrical to each other as shown in FIG. 3. The respective projecting parts 2*ac* and the outer peripheral edge portion of the conductive damper 2*a* are respectively mounted to the upper surface 9*a* of the above described support member 9. The elastic part 2*ad* is formed into a corrugated shape, and plays a role of movably supporting the connecting member 8. A plurality of conductive members 2*ae* are formed by a conductive member and play a role of electrically connecting lead wires 4*a* of the voice coil 4 and the terminal members 21. Each of the conductive members 2*ae* is woven into a flat net shape at a top surface side of the conductive damper 2*a* from an inner peripheral edge portion of the conductive damper 2*a* to an end portion side of the projecting part 2*ac*. The conductive members 2*ae* at the side of the inner peripheral edge portion of the conductive damper 2*a* are electrically connected to connecting parts 21*c* of the respective terminal members 21. Meanwhile, the conductive members 2*ae* at a side of the outer peripheral edge portion of the conductive damper 2*a* are electrically connected to one end sides of respective terminal members 22.

The ordinary damper 2*b* is formed into substantially the same shape as the conductive damper 2*a*. However, the ordinary damper 2*b* does not have the conductive members 2*ae* unlike the conductive damper 2*a*. An outer peripheral edge portion of the ordinary damper 2*b* is fixed to the top surface 9*b* of the support member 9, and an inner peripheral edge portion of the damper 2*b* is fixed to the lower end portion of the connecting member 8 via an adhesive 71.

The terminal member 21 is a member of metal or the like having conductivity, and a plurality of the terminal members 21 are provided. Each of the terminal members 21 is mounted to the connecting member 8. The terminal member 21 has a ceiling wall 21*a*, a connecting part 21*d*, a raised wall 21*e*, a fixing part 21*b*, a bent part 21*f* and a connecting part 21*c*.

The ceiling wall 21*a* is formed into a planar shape, and has a hole 21*ab* substantially in its center. A projecting portion 8*f* of the connecting member 8 which will be described later is inserted into this hole 21*ab*. The connecting part 21*d* is formed by being folded to a lower side from one end side of the ceiling wall 21*a*. The slit 21*da* is formed in the connecting part 21*d* as shown in FIG. 2B. Without being limited to this, the hole 21*db* may be formed in the connecting part 21*d* as shown in FIG. 2C. A lead wire 4*a* of the voice coil 4 is wound around this slit 21*da*. Thereby, the terminal member 21 and the lead wire 4*a* of the voice coil 4 are electrically connected. The raised wall 21*e* extends from the other end side of the ceiling wall 21*a* to the lower side. The fixing part 21*b* is formed into a substantially planar shape, and extends downward from the lower end portion of the raised wall 21*e*. The bent part 21*f* extends substantially perpendicularly to an outside from the lower end part side of the raised wall 21*a*, namely, extends to the opposite side from the direction in which the ceiling wall 21*a* extends, and is bent substantially perpendicularly to the down side at a predetermined position. The connecting part 21*c* extends substantially perpendicularly from the lower end portion side of the bent parts 21*f* to the outside, namely, extends in the opposite side of the direction in which the ceiling wall 21*a* extends. It is noted that the connecting part 21*c* and the ceiling wall 21*a* are substantially parallel.

The terminal member 22 is a member having conductivity, and a plurality of terminal members 22 are provided. Each of the terminal members 22 is fixed to the top surface 9*a* of the support member 9. One end of each of the terminal members 22 is electrically connected to each of the conductive members of the conductive damper 2*a*, and the other end of each of the terminal members 22 is electrically connected to a relay wiring at the side of an amplifier not shown.

The voice coil 4 has a pair of plus/minus lead wires (not shown). The lead wire at the positive side is an input wiring for an L (or R)-channel signal, and the lead wire at the negative side is an input wiring for a ground (GND: ground) signal. Each of the lead wires is electrically connected to an upper end of each of the terminal members 21 as described above. Therefore, an electric signal of one channel is inputted into the voice coil 4 from the amplifier side via each of the terminal members 22, each of the conductive members of the conductive damper 2*a*, each of the terminal members 21 and each of the lead wires.

The diaphragm 1 is formed into a substantially planar shape to be made thin. Various kinds of materials such as paper, high polymer and metal can be applied to the diaphragm 1 in accordance with the various use purposes. An edge part 1*a* which is separate from the diaphragm 1 is mounted to an outer peripheral edge portion of the diaphragm 1. The outer peripheral edge portion of the diaphragm 1 is fixed to the first flange part 10*a*. Meanwhile, an inner peripheral edge portion of the diaphragm 1 is fixed to the vicinity of the upper end of the outer peripheral wall of the voice coil bobbin 3. The inner peripheral edge portion of the diaphragm 1 and the bent portion 8*b* of the connecting member 8 are fixed to each other via the adhesive 71.

Next, each component of the magnetic circuit system 11 will be explained.

The magnetic circuit system 11 is constructed as an internal magnet type magnetic circuit. This magnetic circuit has the pot type yoke 5, the planar magnet 6 and the planar plate 7.

The pot type yoke 5 has a body part 51 and a bottom part 52, and is formed by connecting them. The pot type yoke 5 is mounted to the frame 10.

The body part 51 has a cylinder part 51*a*, a flange part 51*b* and projecting parts 51*c* projecting upward from a top surface of the flange part 51*b*, and is made by integrally forming them. The cylindrical part 51*a* is formed into a substantially cylindrical shape. The cylinder part 51*a* extends upward from the vicinity of the inner periphery of the flange part 51*b* to the position in the vicinity of the plate 7. The flange part 51*b* extends in an outward direction substantially perpendicularly from the vicinity of the lower end of the outer peripheral wall of the cylindrical part 51*a*. The inner peripheral edge portion of the frame 10 is mounted to a top surface of the flange part 51*b*. The projecting part 51*c* is formed into a columnar shape, and a plurality of the projecting parts 51*c* are formed on the top surface of the flange part 51*b* with a constant space apart from each other. Each of the projecting parts 51*c* plays a role of fixing the inner peripheral edge portion of the frame 10 by being caulked.

The bottom part 52 has the sectional shape which is a substantially inversed recessed shape, and has a mounting part 52*a* which has substantially the same size as the diameters of the planar magnet 6 and the planar plate 7. The outer peripheral edge portion of the bottom part 52 is connected to the body part 51.

The planar magnet 6 is fixed onto the mounting part 52*a* of the bottom part 52 of the pot type yoke 5. The planar plate 7 is fixed onto the magnet 6. In the magnetic circuit system 11, the magnetic circuit is constructed by the magnet 6 and the plate 7, and a magnetic flux of the magnet 6 is concentrated to the magnetic gap 20 formed between the outer peripheral wall of the plate 7 and the inner peripheral wall of the pot type yoke 5.

The antidust cap 31 is mounted to an upper end portion of the voice coil bobbin 3 via an adhesive to close a top surface of the voice coil bobbin 3. Thereby, the antidust cap 31 has the function of preventing a foreign matter or the like from entering the inside of the speaker device 100.

Next, various kinds of components will be explained.

Various kinds of components include the members such as packing 13 and a buffering member 14.

The packing 13 is formed into an annular shape, and is a member having insulation properties. As a material of the packing 13, for example, a resin material is preferable. An undersurface of the packing 13 is fixed to the first flange part 10*a* and an outer peripheral edge portion of the edge part 1*a*, respectively. As a result, the outer peripheral edge portions of the diaphragm 1 and the edge part 1*a* are held between the packing 13 and the first flange part 10*a*.

The buffering member 14 has the function as the buffering member when the speaker device 100 is mounted to a predetermined position of a vehicle, for example, and has the function of preventing a vibration from an outside from being transmitted to the body of the speaker device 100. Therefore, a member of sponge or the like having cushioning properties is preferable as the material of the buffering member 14. The buffering member 14 is formed into a rod shape in the state before being mounted, with one side surface coated with an adhesive, or a double-side adhesive tape attached on the one side surface. The buffering member 14 is mounted on the top surface of the packing 13 via the adhesive or the double-side adhesive tape in the state in which it is deformed into an annular shape.

In the speaker device 100 described above, the electric signal outputted from the amplifier side is supplied to the voice coil 4 via each of the terminal parts 22, each of the conductive members of the conductive damper 2*a*, each of the terminal members 21, and each of the lead wires of the voice coil 4. Thereby, a driving force occurs to the voice coil 4 in the magnetic gap 20, which vibrates the diaphragm 1 in the axial direction of the speaker device 100. The speaker device 100 thus emits sound waves in the direction of the arrow 60.

[Construction of Connecting Member 8]

Figure 4:
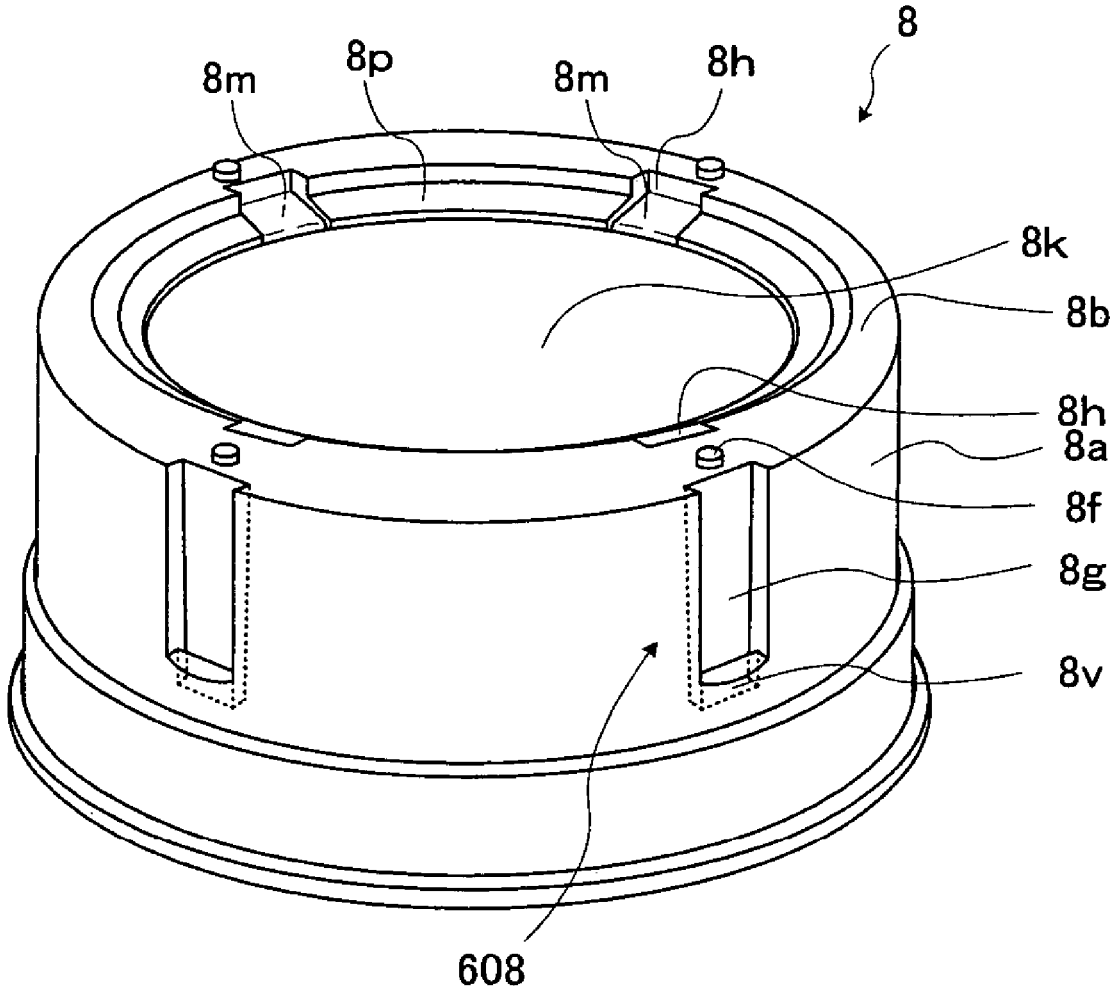
FIG. 4 shows a perspective view of a connecting member according to this embodiment.
Figure 5A:
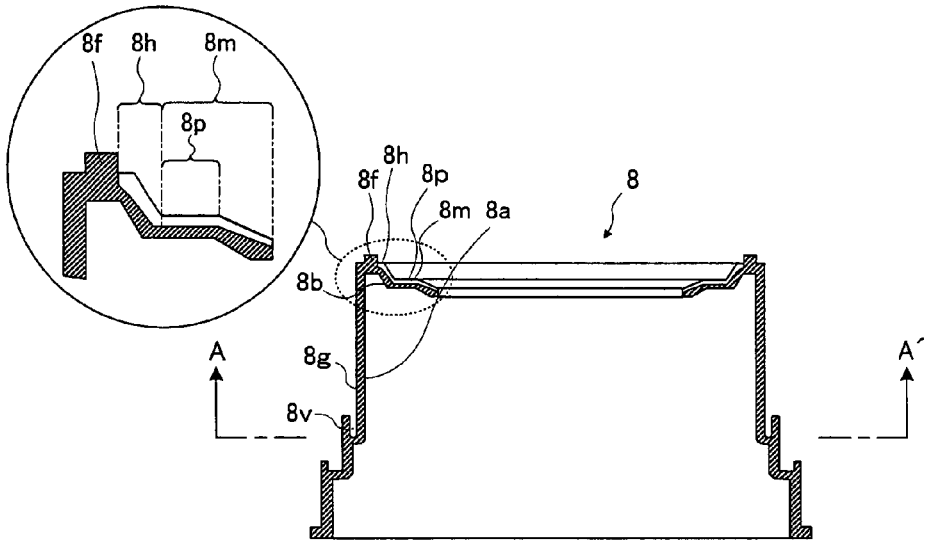
FIG. 5A shows a sectional view of the connecting member according to this embodiment.
Figure 5B:
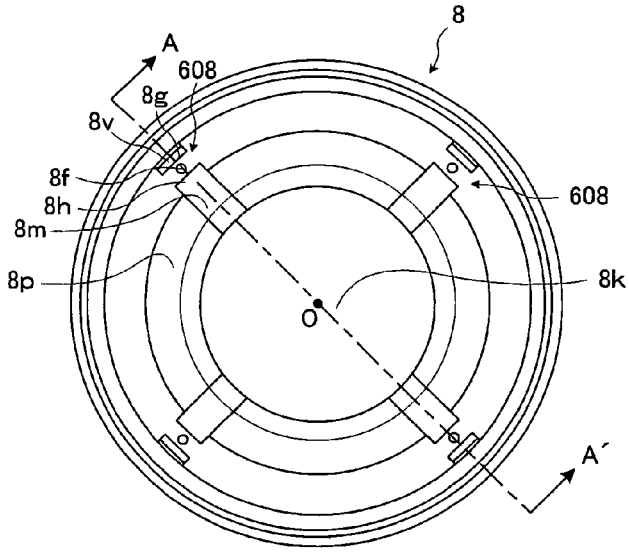
FIG. 5B shows a plan view thereof.
Figure 6:
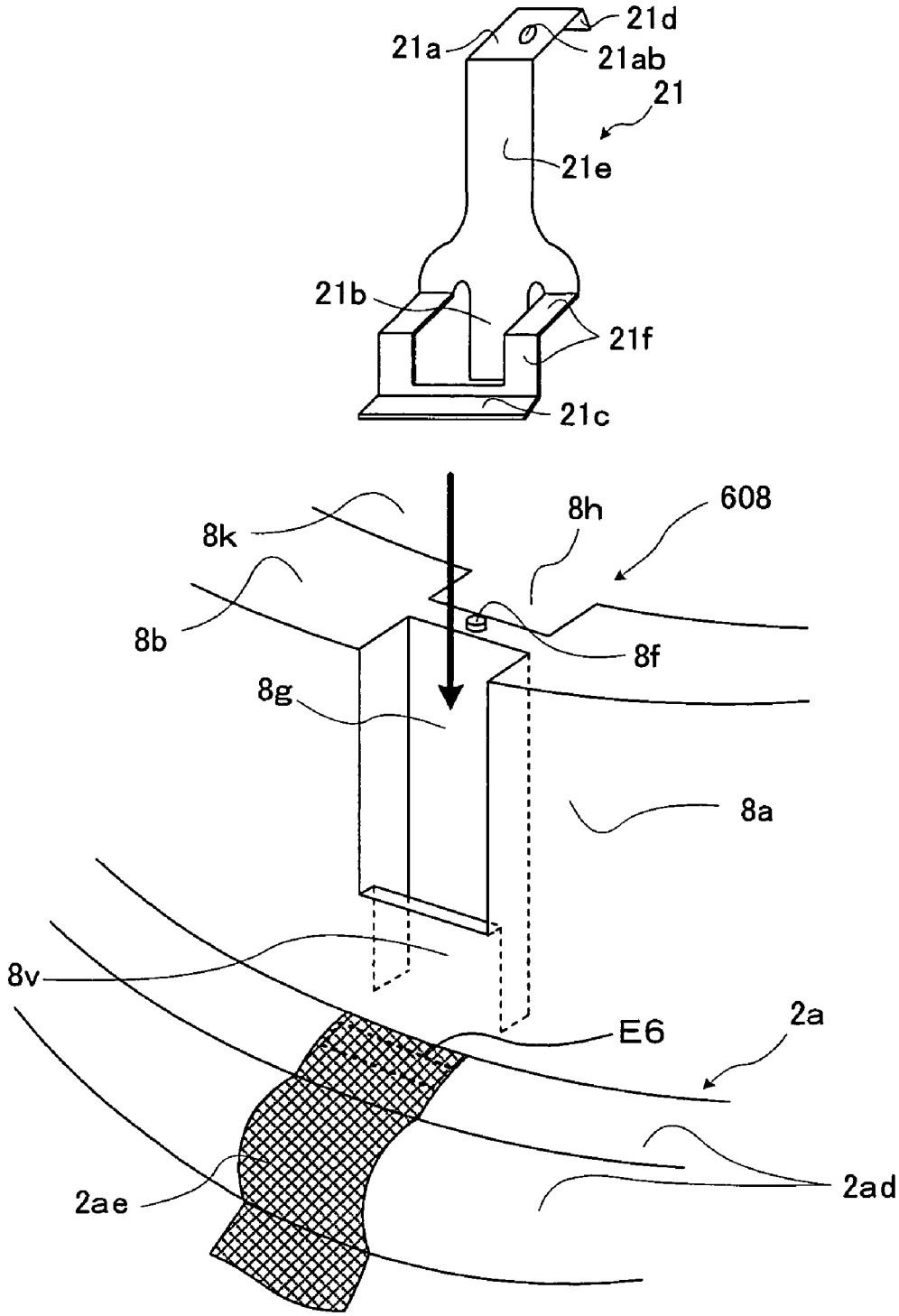
FIG. 6 is a perspective view of a local part of the connecting member and the like, showing a method of mounting the terminal member to the connecting member.
Figure 7B:
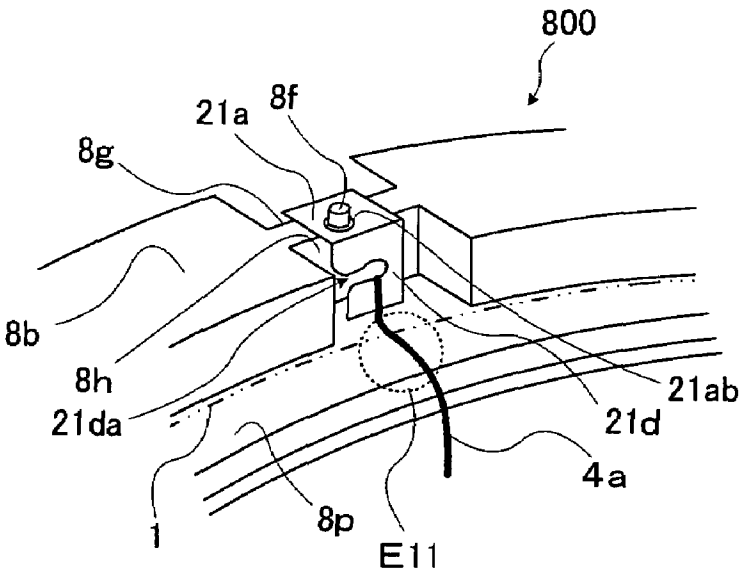
FIGS. 7A and 7B are perspective views of local parts of the connecting member and the like, showing a method of connecting a lead wire and the terminal member.
Figure 7A:
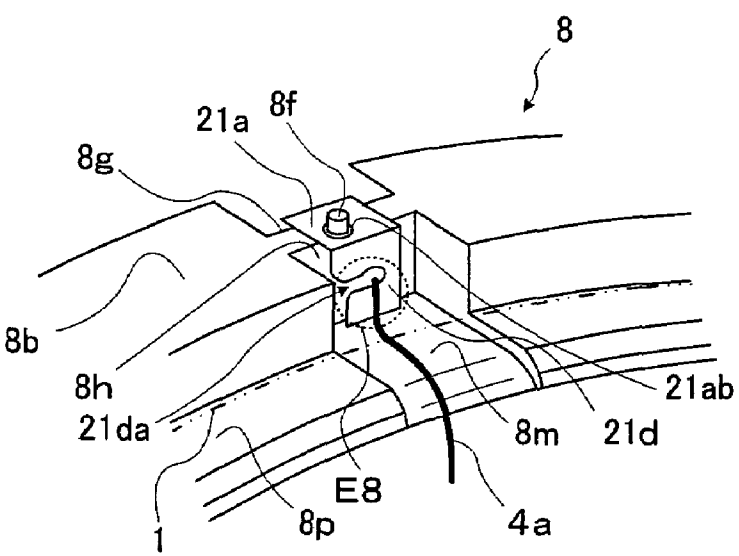
Figure 8:
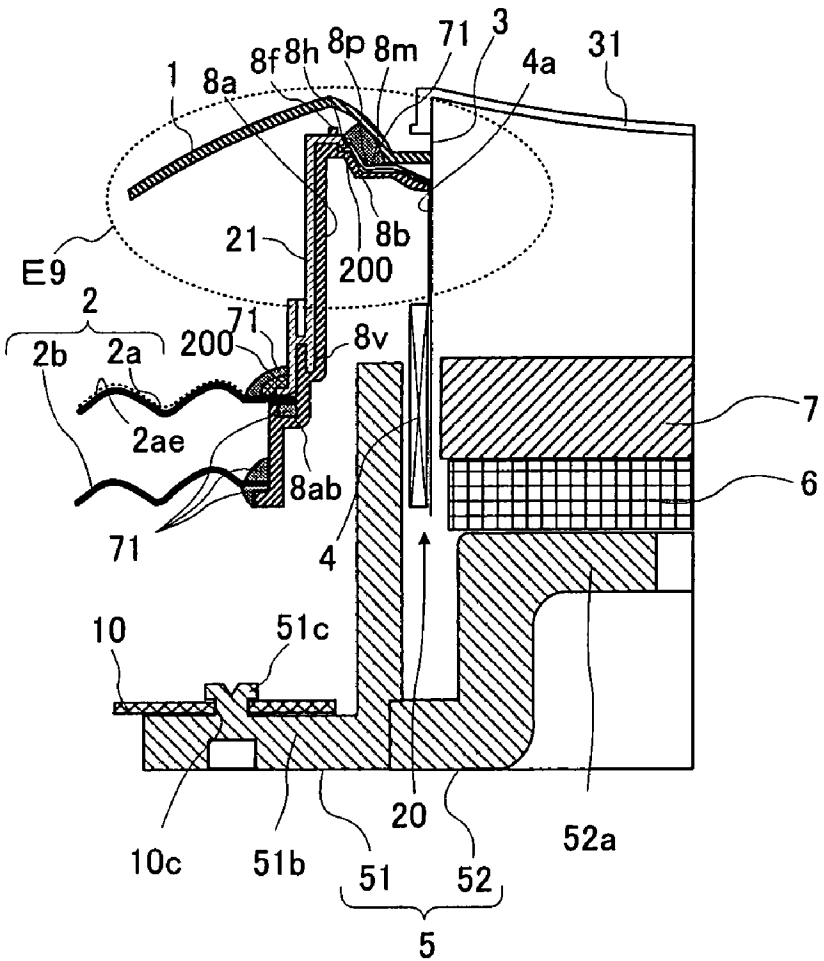
FIG. 8 is a sectional view of a local part of the speaker device in a state that the terminal member is mounted to the connecting member.
Figure 9:
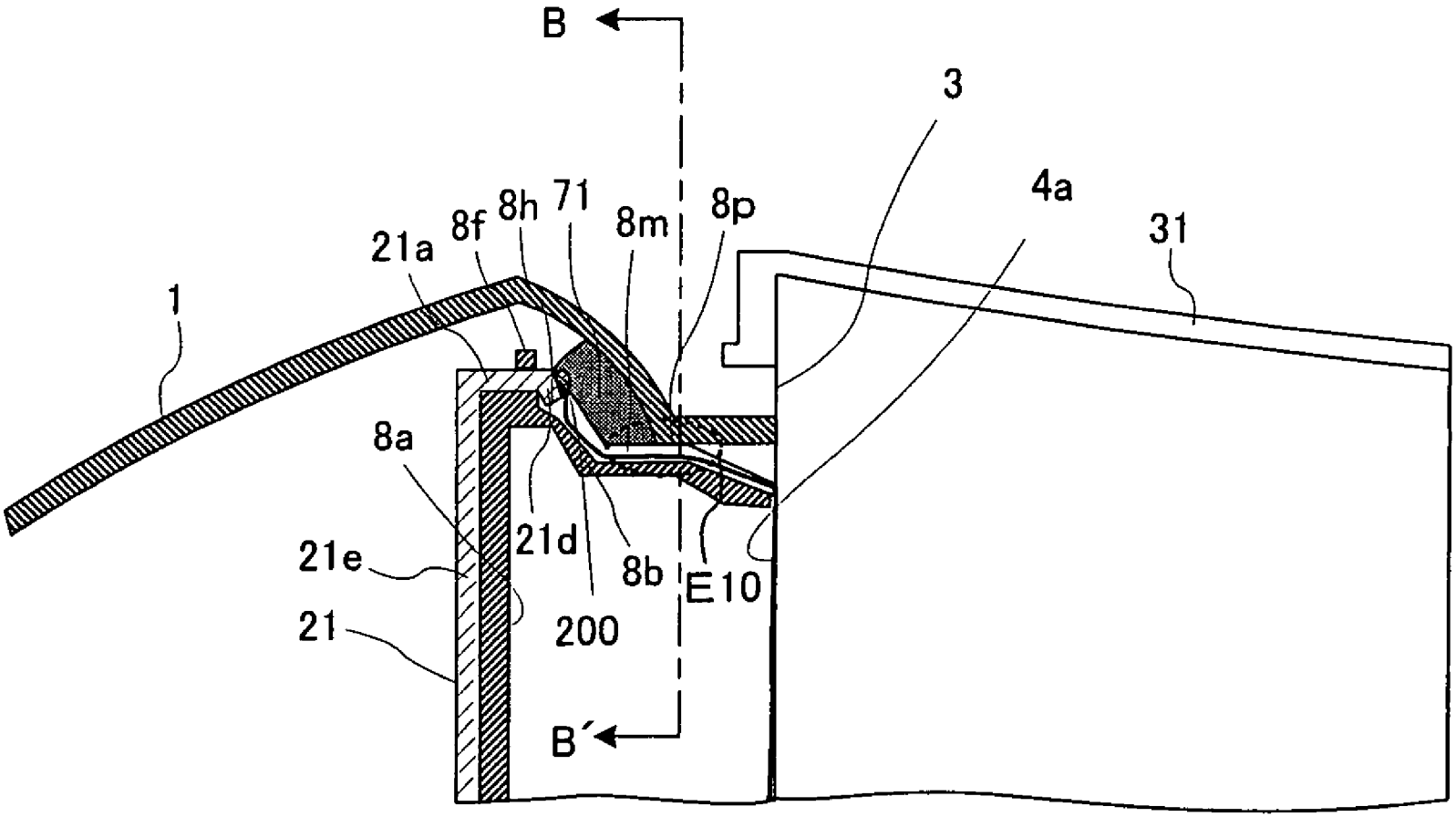
FIG. 9 shows a sectional view in which an area E9 shown in FIG. 8 is enlarged.
Figure 10B:
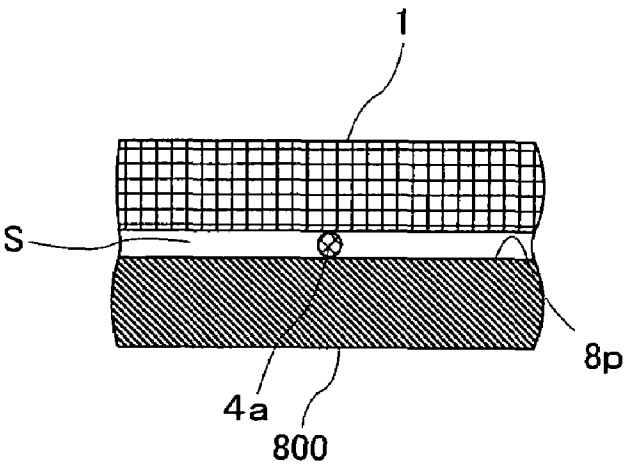
FIGS. 10A and 10B schematically show sectional views of a local part taken along a cutting-plane line B-B' shown in FIG. 9.
Figure 10A:
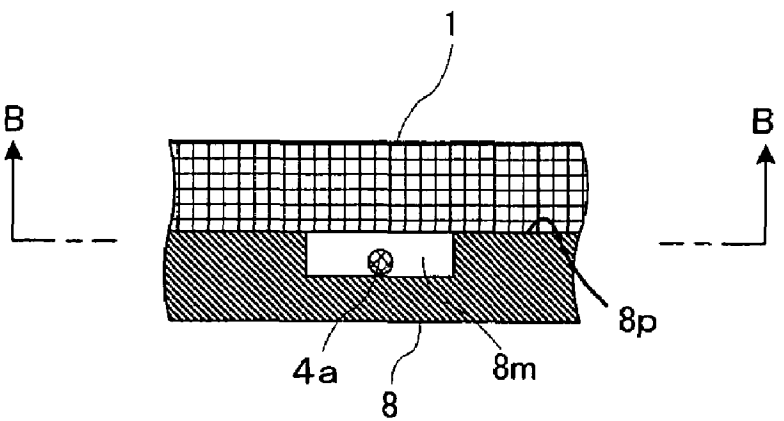

Next, the description will be given of the construction of the connecting member 8 which is a characteristic of the present invention, with reference to FIG. 4 to FIGS. 10A and 10B. FIG. 4 schematically shows a perspective view of the connecting member 8 according to this embodiment. FIG. 5B schematically shows a plan view of the connecting member 8. FIG. 5A schematically shows a sectional view taken along the cutting-plane line A-A' shown in FIG. 5B, and a sectional view in which an area shown by a broken line in FIG. 5A is enlarged. FIG. 6 shows a perspective view of an enlarged local part in the vicinity of the terminal mounting part of the connecting member 8. Additionally, FIG. 6 is a diagram for explaining a method of mounting the terminal member 21 to the connecting member 8 and electrically connecting the voice coil 4 and the conductive damper 2*a*. FIG. 7A shows a perspective view of an enlarged local part in the vicinity of the connecting portion of the connecting part 21*d* and the connecting member 8 having a recessed (concave) portion 8*m*. FIG. 7A is a diagram for explaining a method of connecting the connecting part 21*d* and the lead wire 4*a* of the voice coil 4. FIG. 7B is a diagram corresponding to FIG. 7A, and shows a perspective view of an enlarged local part in the vicinity of the connecting portion of the connecting part 21*d* and a connecting member 800 having no recessed portion 8*m*. FIG. 8 shows a sectional view of an enlarged local part of the speaker device 100 in a state that the terminal member 21 is mounted to the connecting member 8. FIG. 9 shows a sectional view in which an area E9 shown in FIG. 8 is enlarged. FIG. 10A schematically shows a sectional view of a local part taken along the cutting-plane line B-B' shown in FIG. 9. FIG. 10B is a diagram of the connecting member 800 shown in FIG. 7B, corresponding to FIG. 10A.

The basic construction of the connecting member 8 is as described above. The connecting member 8 further includes an opening 8*k*, projecting portions 8*f*, slit portions 8*h*, slit portions 8*g*, grooves 8*v* and a flat surface 8*p* and recessed portions 8*m*, as shown in FIG. 4 and FIGS. 5A and 5B. A plurality of sets of projecting portions 8*f*, slit portions 8*h*, slit portions 8*g* and grooves 8*v* (hereinafter also called "a set of terminal mounting part 608") are formed in a circumferential direction of the connecting member 8 with constant spaces apart from each other. One terminal members 21 is mounted to one set of terminal mounting part 608.

The opening 8*k* is formed substantially at the center of the connecting member 8. The voice coil bobbin 3 is inserted into this opening 8*k*. The projecting portion 8*f* is formed into a substantially columnar shape, and projects upward from an upper end surface of the bent portion 8*b*. The projecting portion 8*f* is inserted into the hole 21*ab* of the terminal member 21. Thereby, the movement of the upper end portion side of the terminal member 21 relative to the connecting member 8 is prevented, and the upper end portion side of the terminal member 21 can be fixed to the connecting member 8. The slit portion 8*h* is the slit formed on the upper end surface of the bent portion 8*b* at the side of the center axis O. The connecting part 21*d* of the terminal member 21 is disposed in this slit portion 8*h*. The slit portion 8*g* is the slit formed in an outer peripheral wall of the cylindrical portion 8*a*. The slit portion 8*g* is formed from the upper end portion of the outer peripheral wall of the cylindrical portion 8*a* to the vicinity of the lower end of the outer peripheral wall of the cylinder portion 8*a*. The raised wall 21*e* of the terminal member 21 is disposed in this slip portion 8*g*. The groove 8*v* is the groove formed at the lower position of the slit portion 8*g*. The fixing part 21*b* of the terminal member 21 is inserted into this groove 8*v*. Thereby, the movement of the lower end portion side of the terminal member 21 relative to the connecting member 8 is prevented, and the lower end portion side of the terminal member 21 can be fixed to the connecting member 8.

The flat surface 8*p* of the bent portion 8*b* has a flatness, similarly to the bottom surface of the inner peripheral edge portion of the diaphragm 1. On the flat surface 8*p*, the bottom surface of the inner peripheral edge portion of the diaphragm 1 is disposed. The recessed portion 8*m* is recessed downward from the flat surface 8*p*, and the recessed depth is larger than the diameter of the lead wire 4*a* of the voice coil 4. The recessed portion 8*m* is formed at the portion at which each terminal mounting part 608 is provided. In addition, the recessed portion 8*m* is formed in the area from the flat surface 8*p* to the inner peripheral edge portion of the connecting member 8, and extends to the slit portion 8*h* and the opening 8*k*. The lead wire 4*a* of the voice coil 4 is drawn in the recessed portion 8*m*. It is noted that the flat surface 8*p*, the slit portion 8*h* and the recessed portion 8*m* are enlarged and shown in FIG. 5A respectively.

Next, the description will be given of the method of mounting the terminal member 21 to the connecting member 8 of this embodiment and electrically connecting the voice coil 4 and the conductive damper 2*a*, with reference to FIG. 6.

The terminal member 21 is mounted to the set of the terminal mounting part 608 in the direction of an arrow shown in FIG. 6. At this time, the projecting portion 8*f* of the connecting member 8 is inserted into the hole 21*ab* of the terminal member 21, and the fixing part 21*b* of the terminal member 21 is inserted into the groove 8*v* of the connecting member 8. Thereby, the terminal member 21 is fixed to the connecting member 8. The bottom surface of the connecting part 21*c* of the terminal member 21 is connected to the conductive member 2*ae* (a portion of an area E6) on the side of the inner peripheral edge portion of the conductive damper 2*a*. Afterward, the contact portion of the connecting part 21*c* and the conductive member 2*ae* is soldered, which is not shown. Thereby, the terminal member 21 and the conductive damper 2*a* are securely electrically connected.

The lead wire 4*a* of the voice coil 4 and the terminal member 21 are connected as follows. Namely, as understood with reference to FIG. 7A, FIG. 8 and FIG. 9, the lead wire 4*a* of the voice coil 4 is drawn along the outer peripheral wall of the voice coil bobbin 3, the inside of the recessed portion 8*m* and the slit portion 8*h* to be wound around the slit 21*da* of the terminal member 21. A portion of an area E8 shown in FIG. 7A is soldered, and the voice coil 4 and the terminal member 21 are electrically connected.

As described above, the terminal member 21 is mounted to the connecting member 8, and the voice coil 4 and the conductive damper 2*a* are electrically connected via the terminal member 21. FIG. 8 shows a state thereof.

In such the state, as understood with reference to FIG. 2A, FIG. 8 and FIG. 9, the connecting part 21*d* is disposed in the slit portion 8*h*. The bottom surface of the ceiling wall 21*a* contacts the upper end surface of the bent portion 8*b*. The raised wall 21*e* is disposed in the slit portion 8*g* of the connecting member 8. The fixing part 21*b* is inserted into the groove 8*v*. The lead wire 4*a* drawn from the voice coil 4 is drawn along the outer peripheral wall of the voice coil bobbin 3, the recessed portion 8*m* and the slit portion 8*h*, and is electrically connected to the connecting part 21*d* of the terminal member 21 by a soldering 200. Meanwhile, the connecting part 21*c* of the terminal member 21 is electrically connected to the conductive member 2*ae* (see the portion shown by the broken line) on the side of the inner peripheral edge portion of the conductive damper 2*a* by the soldering 200.

Next, the description will be given of a characteristic operation and effect of the connecting member 8 of this embodiment, with reference to FIGS. 7A and 7B and FIGS. 10A and 10B. For convenience of explanation, the connecting member 800 having no recessed portion 8*m* and the connecting member 8 having the recessed portion 8*m* according to this embodiment are compared and explained below. The connecting member 800 corresponds to FIG. 7B and FIG. 10B, and the connecting member 8 corresponds to FIG. 7A and FIG. 10A.

As for the connecting member 800, the recessed portion is not formed at a portion of an area E11 on the flat surface 8*p*. On the contrary, as for the connecting member 8, the recessed portion 8*m* is formed at the portion corresponding to the area E11. The inner peripheral edge portion (a portion shown by a two-dot chain line) of the diaphragm 1 is mounted on the flat surface 8*p* via the adhesive. Therefore, in the connecting member 800, as shown in FIG. 10B, the lead wire 4*a* drawn from the voice coil 4 is sandwiched by the bottom surface of the inner peripheral edge portion of the diaphragm 1 and the flat surface 8*p* of the connecting member 8.

Thus, in the connecting member 800, at the time of driving the speaker, the pressure and the like are applied to the portion of the sandwiched lead wire 4*a*, and the lead wire 4*a* may be cut. Meanwhile, in the connecting member 8, as shown in FIG. 10A, since the lead wire 4*a* drawn from the voice coil 4 is drawn not on the flat surface 8*p* but inside the recessed portion 8*m*, the lead wire 4*a* is not sandwiched by the bottom surface of the inner peripheral edge portion of the diaphragm 1 and the flat surface 8*p* of the connecting member 8. Therefore, in this embodiment, at the time of driving the speaker device 100, the pressure and the like are not given to the lead wire 4*a* drawn inside the recessed portion 8*m* from the diaphragm 1 and the connecting member 8. Therefore, the cut of the lead wire 4*a* can be prevented.

In the connecting member 800, as shown in FIG. 10B, since the inner peripheral edge portion of the diaphragm 1 lies over the lead wire 4*a* of the voice coil 4, a space S is formed between the bottom surface of the inner peripheral edge portion of the diaphragm 1 and the flat surface 8*p* of the connecting member 800. Therefore, the contact area of the diaphragm 1 and the connecting member 800 becomes small, and the bonding strength of the diaphragm 1 and the connecting member 8 decreases. Meanwhile, in the connecting member 8, as shown in FIG. 10A, since the inner peripheral edge portion of the diaphragm 1 does not lie over the lead wire 4*a*, the contact area of the inner peripheral edge portion of the diaphragm 1 and the flat surface 8*p* becomes large. Thus, according to this embodiment, the bonding strength (adhesion strength) of the diaphragm 1 and the connecting member 8 can be enhanced.

What is claimed is:

1. A speaker device comprising:

a frame;

a damper which has an outer peripheral edge portion supported by the frame;

a connecting member which is mounted to the damper and which movably supports a voice coil bobbin;

a diaphragm which is mounted to the frame and the connecting member;

a voice coil which is wound around the voice coil bobbin; and a terminal member which has a connecting part to be connected to the lead wire, wherein the connecting member has a flat surface to which an inner peripheral edge portion of the diaphragm is mounted and a recessed portion which is formed on the flat surface and guides a lead wire of the voice coil, wherein the connecting member has a terminal mounting part to which the terminal member is mounted, wherein a slit portion extending to the recessed portion, which the connecting part is disposed at, is formed on an upper end surface of the connecting member, and wherein the lead wire is guided along an outer peripheral wall of the voice coil bobbin, the recessed portion and the slit portion to be connected to the connecting part.

2. The speaker device according to claim 1, wherein the inner peripheral edge portion of the diaphragm is mounted on the flat surface via an adhesive.

3. The speaker device according to claim 1, wherein the recessed portion is formed at a position in a vicinity of the terminal mounting part and at an area from the flat surface to an inner peripheral edge portion of the connecting member.

4. The speaker device according to claim 1, wherein a depth of the recessed portion is larger than a diameter of the lead wire.

* * * * *